US006520813B1

(12) United States Patent
DeVito, Jr.

(10) Patent No.: US 6,520,813 B1
(45) Date of Patent: Feb. 18, 2003

(54) TROLLING MOTOR MOUNTING MEANS

(76) Inventor: Richard D. DeVito, Jr., 2563 SE. Conch Cove La., Palm City, FL (US) 34990

( * ) Notice: Subject to any disclaimer, the term of this patent is extended or adjusted under 35 U.S.C. 154(b) by 0 days.

(21) Appl. No.: 09/928,231

(22) Filed: Aug. 10, 2001

(51) Int. Cl.[7] ..... B60L 11/02
(52) U.S. Cl. ..... 440/6; 440/53; 114/285
(58) Field of Search ..... 248/640, 641, 248/642, 643; 440/6, 53, 61–63; 114/284, 285, 286; D12/317

(56) References Cited

U.S. PATENT DOCUMENTS 2,886,462 A * 5/1959 Jagiel ..... 114/285
3,075,490 A * 1/1963 Lang ..... 114/279
4,367,860 A * 1/1983 Strang ..... 248/641
4,384,856 A * 5/1983 Hall et al. ..... 248/642
4,577,580 A * 3/1986 Diffely, Sr. ..... 114/145 A
4,832,642 A * 5/1989 Thompson ..... 114/285
4,890,811 A * 1/1990 Ehni ..... 248/641
5,017,165 A * 5/1991 Havins ..... 114/274
5,350,327 A * 9/1994 Self et al. ..... 114/274
5,704,308 A * 1/1998 Anderson ..... 114/285
5,842,895 A * 12/1998 DeVito, Jr. ..... 114/285
5,878,686 A * 3/1999 Anderson ..... 114/285

* cited by examiner

*Primary Examiner*—S. Joseph Morano
*Assistant Examiner*—Ajay Vasudeva
(74) *Attorney, Agent, or Firm*—Kilgannon & Steidl

(57) ABSTRACT

A trolling motor mount with a first piston controlled plate-like trim tab member for hinged attachment to a boat transom and terminating rearwardly in a narrow tongue with a curved end; a second plate-like member welded to the first plate-like member forward of the tongue and with depending sides a portion of which are welded to the first plate-like member and the tongue; the second plate-like member extending upwardly at a substantial angle to the first plate-like member; a trolling motor attached beneath the second plate-like member; the tongue having a width approximating the trolling motor width; a reinforcing channel welding to the first plate-like member and tongue; the tolling motor mount having a first position when the second plate-like member and trolling motor extend out of the water, and a second position where the second plate-like member and trolling motor are submerged at an approximately horizontal trolling position.

15 Claims, 4 Drawing Sheets

TROLLING MOTOR MOUNTING MEANS

FIELD OF THE INVENTION

The present invention relates to a trolling motor mount for fishing boats operated at low speed by one or more trolling motors. The present invention also relates to boats which operate through use of a main motor at higher operating speeds and which utilize trim tabs to fine tune the orientation of the boat at the higher running speeds.

BACKGROUND OF THE INVENTION

Boats used for sport fishing often utilize one or more low-powered trolling motors directly mounted onto the rear transom of the boat on one or both sides of the high-powered main motor. The main motor mounted to the transom is utilized to drive the boat when it traverses between port and the selected fishing area, or from one fishing area to another. When the boat reaches the desired fishing area, the main motor is angularly elevated out of the water, often by electrical and hydraulic means, and the trolling motors are angularly lowered into the water. The type of trolling motors commonly used often do not have electrical means to raise and lower the motor in and out of the water, thus necessitating the manual operation thereof.

Prior to or after trolling operation, the trolling motors are raised out of the water, the main motor is lowered into the water, and the boat is driven at higher running speed. During the higher speed operation, it is known to utilize planar trim tabs or plates attached to the bottom of the transom on each side of the main motor. Each trim tab is operated by a piston from an out-of-the-water position to a position whereby the planar tab extends down into the water. The extent that the planar tab extends into the water can be varied by the piston so that the front to rear and side to side orientation of the boat can be fine tuned while operating at higher running speed.

It is also known to mount the trolling motor directly on the top of the planar trim tab or plate, the plate then serving as both the trim tab in one position and as a trolling motor mounting in a second lower position. However, such a mounting system has not been found to operate satisfactorily for reasons including that the trolling motor is angled into the water, the trolling motor's operation is partly obstructed, and the trolling motor cannot be positioned sufficiently below the surface of the water and in the proper orientation to prevent cavitation.

The invention disclosed in my prior patent, U.S. Pat. No. 5,842,895 issued Dec. 1, 1998 and here incorporated by reference, has overcome the deficiencies of the above-noted prior art. A trolling motor mount is disclosed in my prior patent whereby the trolling motor may be automatically rather than manually raised from, or lowered to, its non-obstructed full operation position immersed in the water at a sufficient depth to avoid cavitation. Further, a portion of the motor mount may be utilized as a trim plate when the trolling motor is automatically raised out of the water. The trolling motor mount of my prior patent includes a first planar plate having its front edge hingedly attached to the rear of the boat transom adjacent the bottom thereof. A second planar plate (or continuation of the first plate) has its front edge or end attached adjacent to the rear of the first plate, the second planar plate extending rearwardly at a predetermined substantial angle from the plane of the first plate. A trolling motor is attached to the bottom of the second plate. A controllable piston is connected between the top of the first plate and the upper part of the boat transom. When the boat is to operate at running speed under the power of the main motor, the first plate can be rotated about its hinge connection to the transom to a first position where the first plate will act as a trim tab or plate. In this first position, the second plate extends upwardly out of the water and consequently the trolling motor on the bottom of the second plate also extends upwardly out of the water. When it is desired to operate the boat for trolling, the main motor is turned off and elevated out of the water. The first plate is then rotated about its hinge connection to a second position lower than the first position extending sufficiently down into the water such that the second plate and trolling motor attached to its bottom are immersed at an approximately horizontal trolling position in the water. The first plate does not obstruct the operation of the trolling motor since the trolling motor is attached to the bottom of the second plate and is lower in the water than both the first and second planar plates. The trolling motor, by virtue of being attached to the bottom of the second plate, is also sufficiently below water line to avoid cavitation affecting the operating characteristics of the motor. Electrical control wiring extends from the trolling motor to control means in the boat.

SUMMARY OF THE INVENTION

The present invention is intended to add certain structural improvements and refinements to the trolling motor mount of my above-noted prior patent, while still maintaining the advantages of the same mode of operation. In the present invention, the trolling motor mount also may be automatically raised from, or lowered to, its non-obstructed full operational position immersed in the water at a sufficient depth to avoid cavitation. Further, a portion of the motor mount may be utilized as a trim plate or tab when the trolling motor is automatically raised out of the water.

The trolling motor mount of the present invention has a first plate-like member having a front end of predetermined width, and a rear end terminating in a rearwardly extending tongue of significantly narrower width than said predetermined width. The front end of the first plate-like member is hingedly attached to the rear transom of the boat adjacent the bottom of the transom. A second plate-like member, whose width may approximate the width of the tongue, has a front end attached to the first plate-like member at a position forwardly of the tongue for structural integrity. The second plate-like member overlies the tongue and extends rearwardly at a predetermined substantial angle from the plane of the first plate-like member. The second plate-like member preferably has downwardly depending sides, with the front of the second plate-like member attached (i.e., as by welding) to the first plate-like member, and portions of said downwardly depending sides being attached (i.e., as by welding) to both said first plate-like member and said tongue. A structural reinforcing beam or channel member may be attached to both the top of the first plate-like member and said tongue for further structural integrity of the mount. Said reinforcing beam also may provide connection points for pivotal connection of one end of a controllable piston to raise and lower the trolling motor mount, the second end of the piston being pivotally connected to the upper part of the boat transom.

The trolling motor is preferably attached to the underside of the second plate-like member. The width of the tongue preferably approximates the width of the trolling motor so that the flow of water to the blades of the trolling motor are not obstructed. The length of the tongue is likewise preferably such that when the trolling motor mount is in its down, operating position, the tongue length does not interfere with the flow of water to the trolling motor blades. The tongue also aids in weed-free operation of the trolling motor, and extends the water flow off the first plate-like member. The rearward end of the tongue is curved to assist in water flow in either the higher speed or trolling speed operations of the present invention.

When the boat is operating at running speed under main motor power, the first plate-like member can be rotated about its hinge connection to the transom to a first position where the first plate-like member will function as a trim tab. The second plate-like member as well as the trolling motor extend upwardly out of the water. When it is desired to operate the boat for trolling, the main motor is turned off and elevated out of the water. The first plate-like member is then rotated about its hinge connection to a second position lower than the first position extending sufficiently down into the water such that the second plate-like member and trolling motor attached to its bottom are immersed at an approximately horizontal trolling position in the water and at a depth to avoid cavitation affecting the operating characteristics of the motor. Electrical control wiring extends from the trolling motor to control means in the boat.

DETAILED DESCRIPTION OF EMBODIMENT

Figure 4:
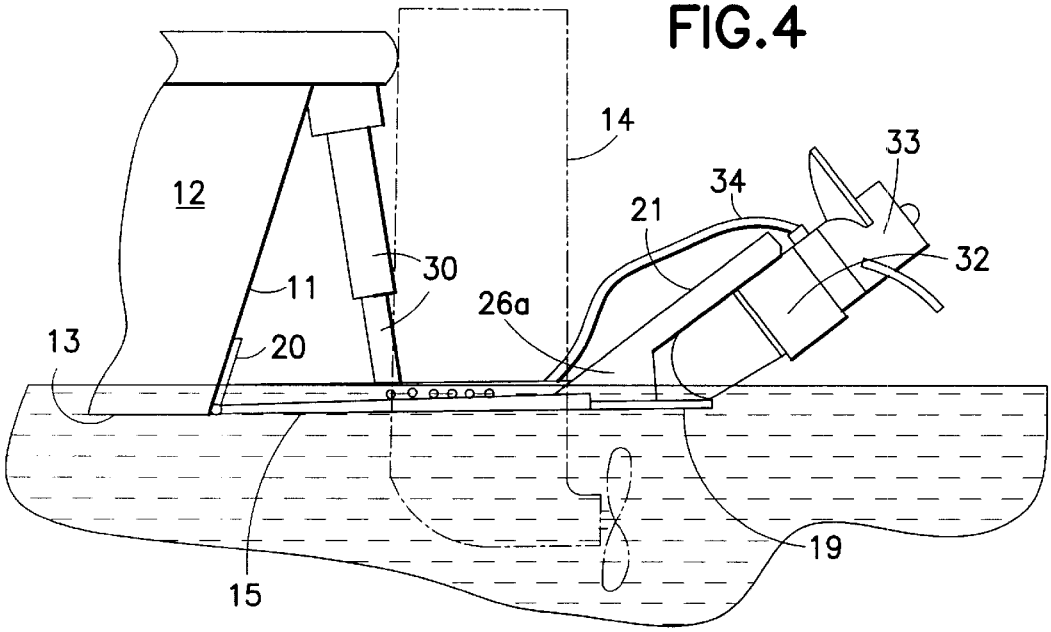
FIG. 4 is a side view of the trolling motor mount of the present invention attached to a boat and having a trolling motor attached to the mount, the first plate-like member of the mount being in its first position, and the second plate-like member and trolling motor being positioned and extending at a substantial angle out of the water.
Figure 5:
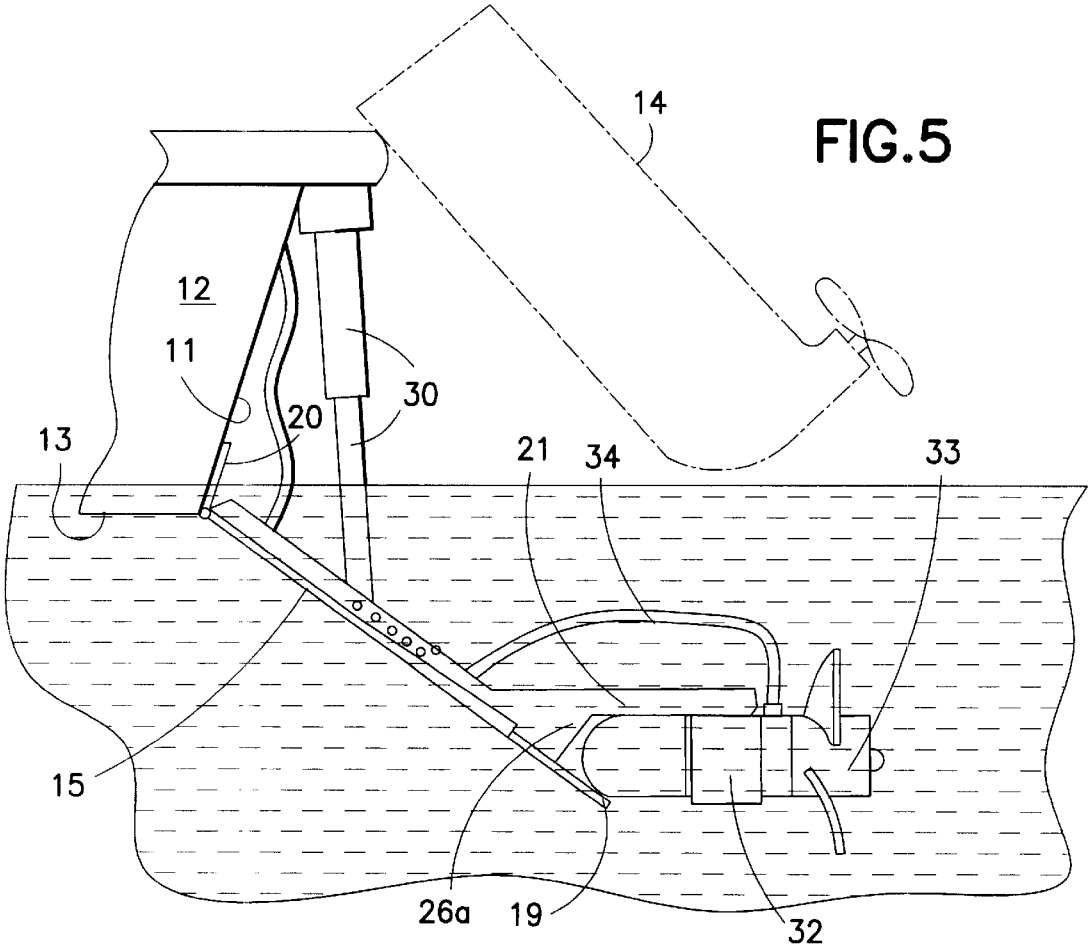
FIG. 5 is a side view corresponding to FIG. 4 but with the first plate-like member of the trolling motor mount in its second, lower, position and the second plate-like member and its underlying trolling motor immersed in operational position in the water.

Reference is made to FIGS. 4 and 5, illustrating trolling motor mount 10 attached to the rear transom 11 of boat 12 adjacent the bottom 13 of transom 11. One trolling motor mount may be attached on each side of the transom 11, with the main power motor 14 for the boat positioned therebetween in its usual position and shown schematically in dotted-line.

Figure 1:
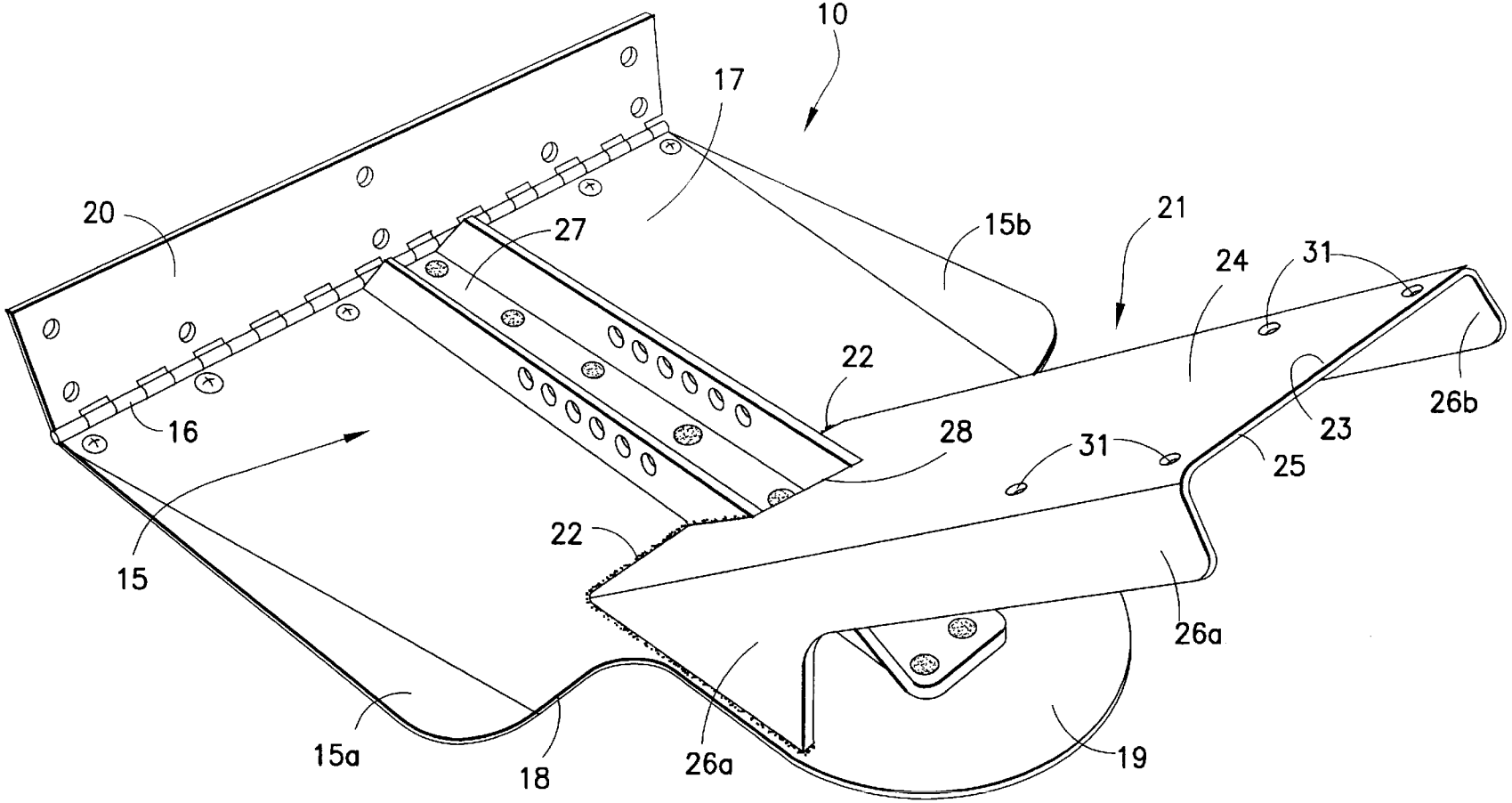
FIG. 1 is an oblique overhead perspective view of the assembled trolling motor mount of the present invention.
Figure 2:
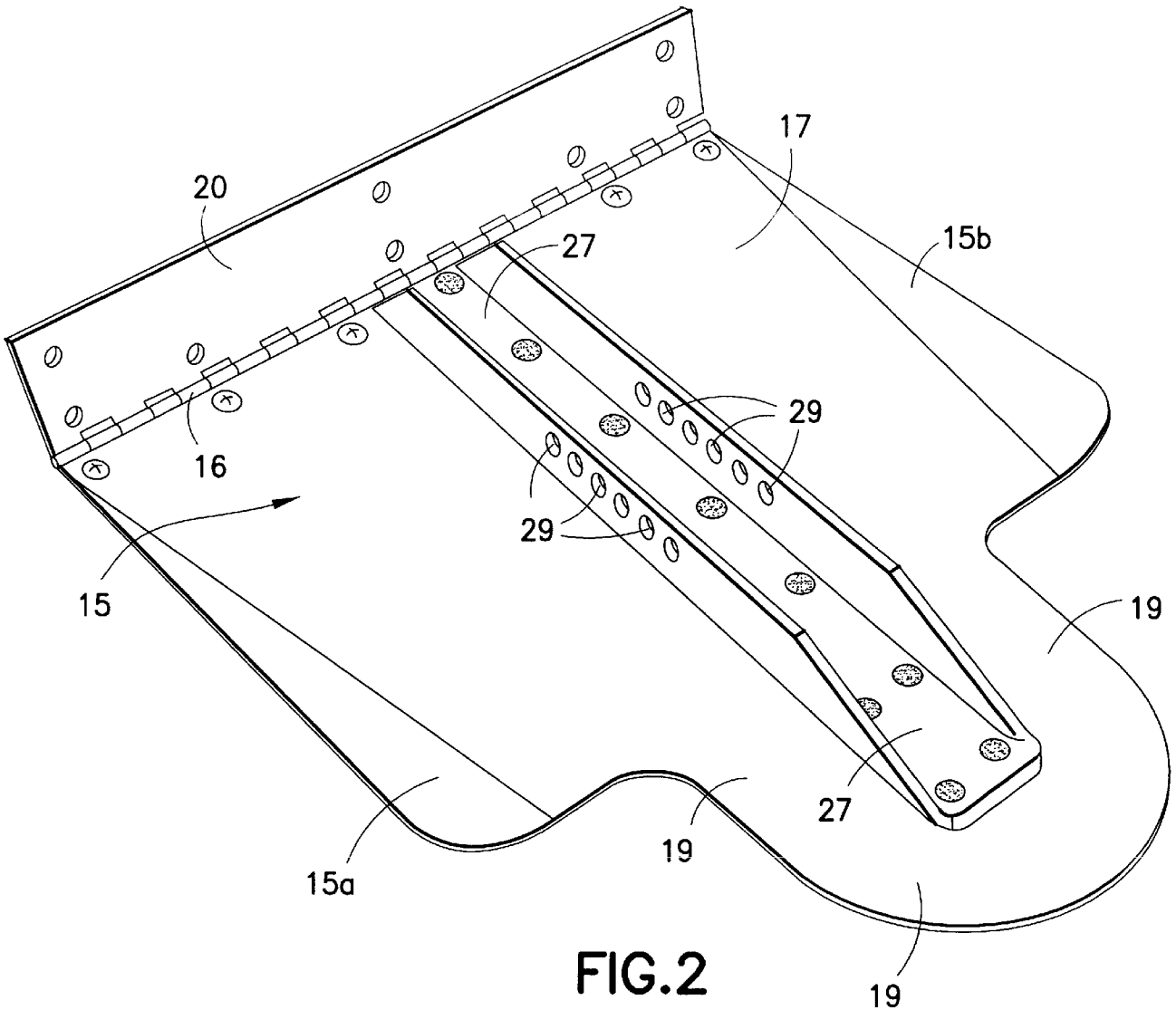
FIG. 2 is an enlarged view in orientation corresponding to FIG. 1, and illustrating certain components of the trolling motor mount of the resent invention.
Figure 3:
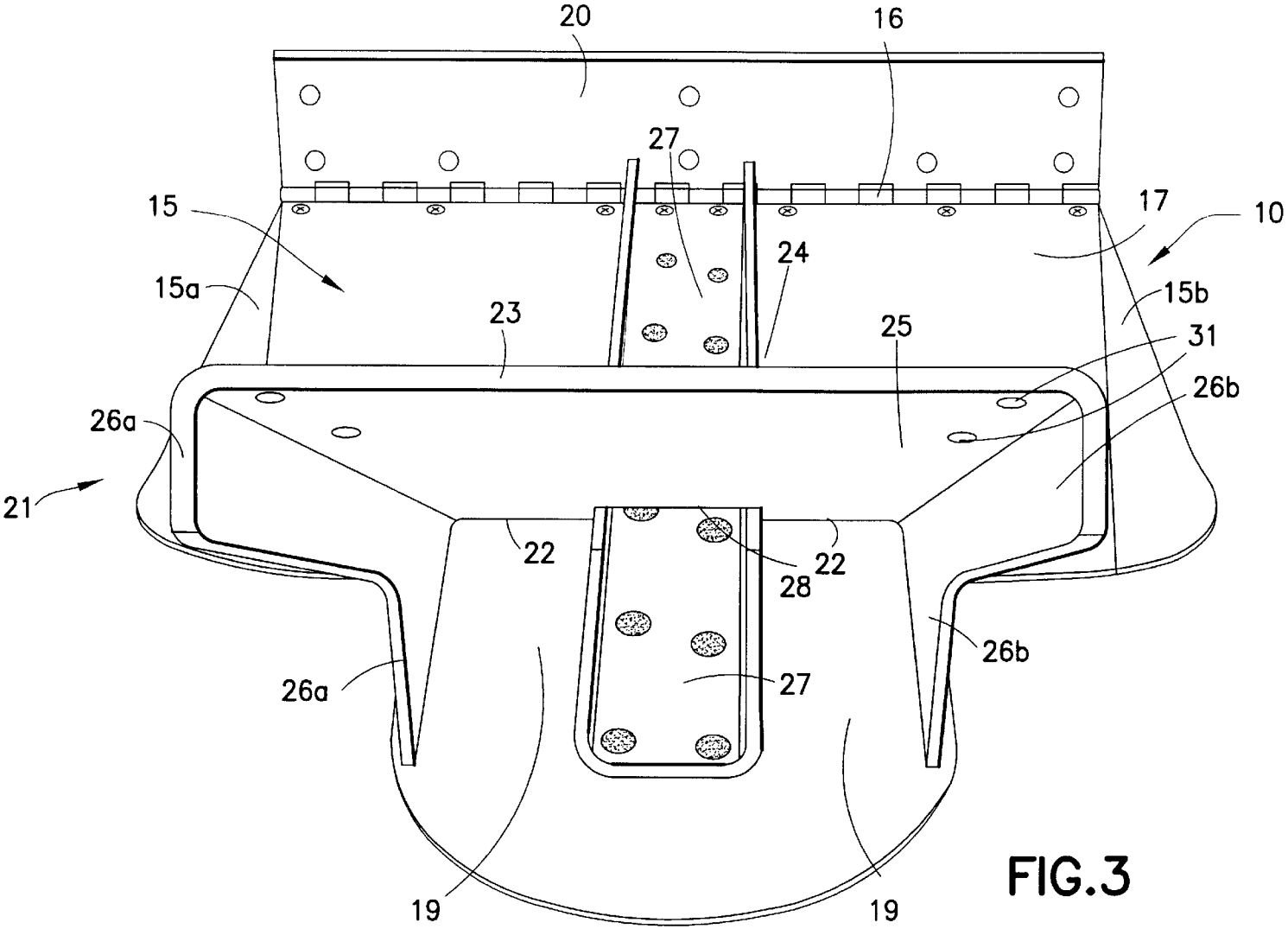
FIG. 3 is an overhead perspective view from the rear of the assembled trolling motor mount of the present invention.

The trolling motor mount, as shown in more detail in FIGS. 1–3, includes a first steel plate-like member 15 having front edge 16, top 17, bottom 18 and a rear portion terminating in tongue 19 lying in the same plane as the remainder of plate-like member 15. Member 15 has a predetermined side-to-side width (for example, twelve inches) that is considerably larger than the side-to-side width of tongue 19 (for example five and one-quarter inches), member 15 serving as a trim tab when the trolling motor mount is in its non-operational position. Plate-like member 15 may have upwardly turned reinforcing sides 15*a*, 15*b*. The front edge 16 is attached to transom 11 by hinged member 20 so that plate-like member 15 can pivot upwardly toward and downwardly away from transom 11. Hinge member 20 will be parallel to the underlying bottom of transom 11, which bottom may be flat in a flat-bottomed boat or which may be angled downwardly toward the boat center line at a small angle in boats with corresponding profile.

The trolling motor mount 10 further includes a second steel plate-like member 21 having a front edge 22, a rear edge 23, a top 24, a bottom (underside) 25, and downwardly depending sides 26*a* and 26*b*. Front edge 22 is welded to first plate 15 as shown in FIG. 1 at a position forward of tongue 19. If plate-like member 15 is twelve inches from front to rear with tongue 19 extending an additional five inches to the rear, solely as an example, front edge 22 may be welded to plate 15 four inches forward of tongue 19 (eight inches rearward of the front edge 16). If plate-like member 15 is nine inches from front to rear with tongue 19 extending an additional five inches to the rear, solely as an example, front edge 22 may be welded to plate 15 one inch forward of tongue 19 (eight inches rearward of the front edge 16). Second plate-like member 21 overlies tongue 19 and extends rearwardly and upwardly at a predetermined substantial angle. An angle of thirty-nine degrees has been used for a nine inch front plate 15, and an angle of twenty-seven degrees has been used for a twelve inch front plate 15. Plate 21 may have a front to rear length of eleven inches (for the nine inch front plate 15) or thirteen to fourteen inches (for the twelve inch front plate 15). Portions of downwardly extending sides 26*a* and 26*b* of plate-like member 21 are likewise welded to plate-like member 15 as shown in FIG. 1, in the same manner on both sides of plate 21, and likewise in the same manner on both sides to tongue 19 as shown. It is therefore apparent that plate-like members 15 and 21 are attached to each other with great structural integrity.

Further to insure structural integrity to the trolling motor mount, as well as to provide a convenient piston connection, structural reinforcing beam member or channel 27 is spot-welded to both first plate-like member 15 and tongue 19 (see FIG. 2). Beam 27 also passes through a hole 28 in second plate-like member 21, and is welded to the edges of hole 28. Beam 27 further has a series of attachment holes 29 along its length for selective pivotal attachment at a desired location of one end of actuator piston cylinder 30. The other end of piston cylinder 30 is pivotally connected to the upper part of the boat transom or structure thereabove.

It will be seen that plate-like member 21 has attachment holes 31 in its top surface for an attachment strap or frame or yoke 32 to be bolted, said strap or frame or yoke surrounding trolling motor 33 when attached to the underside or bottom 25 of second plate-like member 21 as shown in FIGS. 4, 5. Trolling motor 33 has electrical control connections 34 extending back into the boat for operation from the boat.

Referring to FIGS. 4 and 5, it can be seen that when first plate-like member 15 is rotated by electrically actuated piston cylinder 30 as electrically controlled from the boat to a first position as shown in FIG. 4, the second plate-like member 21 and attached trolling motor 33 extend upwardly out of the water. Plate 15 can then serve as a trim tab when the boat is operated by its main motor, to fine-tune the orientation of the boat at higher speeds in known fashion. Slight control adjustments of piston 30 about this first position allow slightly different trim plate angles to be used. Trolling motor 33, by virtue of being out of the water, does not interfere with the higher running speed operation of the boat nor with boat hole shot operation. However, when first plate-like member 15 is rotated by piston cylinder 30 to a second position as shown in FIG. 5, the second plate-like member 21 extends sufficiently down into the water such that the second plate-like member 21 and attached trolling motor 33 are immersed at an approximately horizontal trolling position in the water. In this position, the main motor is generally lifted out of the water.

Piston 30 also has a position, not shown, wherein plate 15 extends substantially horizontally and does not function as a trim tab; i.e., at certain boat speeds or during storage or trailering. Piston 30 may be infinitely varied in position from its non-extended to its fully-extended position over a distance of four and one-quarter inches, and may be a Lenco piston, for example.

Tongue 19 in the present invention has a side-to-side width corresponding to the side-to-side width of the trolling motor 33 plus the width of the strap or frame or yoke pieces adjacent the sides of the motor 33 and the width of the downwardly depending sides 26*a,* 26*b* in turn welded to the tongue edges as shown. For a four inch wide motor, the tongue width accordingly is about five and one-quarter inches. In other words, the tongue width approximates the motor width. In the down operating position of the trolling motor 33, the width of tongue 19 then will not interfere with the water flow to the blades of trolling motor 33 when operating. Likewise, tongue 19 has a front to rear length that is not so long as to interfere with the water flow to the blades of trolling motor 33 when operating (see FIG. 5). Tongue 19 further serves to extend the water flow off the first plate-like member 15, protects the trolling motor 33, and by its position aids in weed-free operating of trolling motor 33 by deflecting encounted weeds. The curved rearward end of tongue 19 aids in improving the water flow to the trolling motor. Additionally, the top rearward surface of tongue 19 may serve as a support against which the forward end of the trolling motor may rest.

It will be appreciated by persons skilled in the art that variations and/or modifications may be made to the present invention without departing from the spirit and scope of the invention. The present embodiment is, therefore, to be considered as illustrative and not restrictive. Merely as an example, plate 15 may be an open framework rather than a closed plane if plate 15 is not to be used as a trim tab. Plate 21 may be an open framework rather than a closed plane for mounting trolling motor 33. Trolling motor 33 also can be mounted to the top of plate 21, though less advantageously to its operation. It should also be understood that such terms as "front", "rear", "upper", "lower", "top" and "bottom", and corresponding similar positional terms as used in the specification are intended in relation to the positioning shown in FIGS. 1–5 and are not otherwise intended to be restrictive.

What is claimed is:

1. A trolling motor mount for use with a boat comprising a first plate-like member having a front end of predetermined width, a top and a bottom, and a rear end terminating in a rearwardly extending tongue of significantly narrower width than said front end predetermined width; means for hingedly attaching the front end of the first plate-like member to the rear transom of the boat adjacent the bottom of the transom; a second plate-like member having a front end, a top and bottom and a rear end; the front end of the second plate-like member being attached to the first plate-like member at a position forward of the rearwardly extending tongue, said second plate-like member overlying said tongue and extending rearwardly at a predetermined substantial angle from the plane of the first plate-like member; means for attaching a trolling motor to the second plate-like member; a controllable piston and means for pivotally attaching the controllable piston to the top of the first plate-like member; whereby the first plate-like member can be rotated by the piston to a first position with the second plate-like member extending upwardly out of the water, and to a lower, second position extending sufficiently down into the water such that the second plate-like member and attached trolling motor are immersed at an approximately horizontal trolling position in the water.

2. The invention of claim 1, wherein said tongue has a width approximating the width of the trolling motor to be attached to said second plate-like member.

3. The invention of claim 2 wherein said second plate-like member has a width approximately the width of said tongue.

4. The invention of claim 1, wherein the trolling motor is attached to the bottom of the second plate-like member.

5. The invention of claim 4, wherein said first and second plate-like members are metal members, said second plate-like member having downwardly depending sides, and the front of said second plate-like member being welded to said first plate-like member.

6. The invention of claim 5, wherein portions of said downwardly depending sides of said second plate-like member are attached to both said first plate-like member and said tongue.

7. The invention of claim 4, wherein said second plate-like member has an opening adjacent the front end thereof; further including a structural reinforcing beam member attached to the top of said first plate-like member both on said tongue and forward of said tongue, said structural reinforcing beam member passing through said opening in said second plate-like member.

8. The invention of claim 7, wherein said structural reinforcing beam member is welded to the periphery of said opening.

9. The invention of claim 4, wherein said trolling motor when attached to said second plate-like member has a front portion resting on said tongue.

10. The invention of claim 1, wherein the first plate-like member is of sufficient size to act as a trim tab when the first plate-like member is rotated by the piston to said first position.

11. The invention of claim 1, wherein the predetermined substantial angle is in the range of approximately twenty to forty-five degrees.

12. The invention of claim 1, including trolling motor control means operated from the boat and electrically connected to the trolling motor.

13. The invention of claim 1, including the controllable piston being electrically actuated and having a first end pivotally connected to the first plate-like member and a second end pivotally connected to the boat transom.

14. The invention of claim 1, wherein said rearwardly extending tongue terminates in a curved periphery.

15. The invention of claim 1, wherein said tongue has a length such as not to significantly interfere with water flow to the trolling motor in its operating position.

* * * * *